US007040418B2

(12) United States Patent
Slater et al.

(10) Patent No.: US 7,040,418 B2
(45) Date of Patent: May 9, 2006

(54) PROPPANT RECOVERY SYSTEM

(75) Inventors: Martin Slater, Tananger (NO); Daniel Perez, Milan (IT); Nicholas Hilbig, Stavanger (NO); Gary Dietzen, Lafayette, LA (US); Brian Campbell, Inverbervie (GB)

(73) Assignee: M-I L.L.C., Houston, TX (US)

( * ) Notice: Subject to any disclaimer, the term of this patent is extended or adjusted under 35 U.S.C. 154(b) by 29 days.

(21) Appl. No.: 10/284,125

(22) Filed: Oct. 30, 2002

(65) Prior Publication Data

US 2003/0106713 A1 Jun. 12, 2003

Related U.S. Application Data

(60) Provisional application No. 60/336,246, filed on Nov. 2, 2001.

(51) Int. Cl.
*E21B 21/06* (2006.01)
*B09B 5/00* (2006.01)

(52) U.S. Cl. ..... 175/66; 175/206; 175/207

(58) Field of Classification Search ..... 175/66, 175/206, 207, 88; 134/108; 210/767, 768
See application file for complete search history.

(56) References Cited

U.S. PATENT DOCUMENTS 4,126,181 A * 11/1978 Black ..... 166/280.2
4,183,813 A * 1/1980 Black et al. ..... 210/512.1
4,448,709 A * 5/1984 Bullen ..... 366/241
4,486,317 A * 12/1984 Sandell ..... 507/110
5,402,857 A 4/1995 Dietzen ..... 175/66
5,564,509 A 10/1996 Dietzen ..... 175/66
5,839,521 A 11/1998 Dietzen ..... 175/66
5,842,529 A 12/1998 Dietzen ..... 175/66
5,913,372 A 6/1999 Dietzen ..... 175/66
5,971,084 A 10/1999 Dietzen ..... 175/66
6,009,959 A 1/2000 Dietzen ..... 175/66
6,179,070 B1 1/2001 Dietzen ..... 175/66
6,179,071 B1 1/2001 Dietzen ..... 175/66
6,213,227 B1 4/2001 Dietzen ..... 175/66
6,419,019 B1 * 7/2002 Palmer et al. ..... 166/311
6,644,844 B1 * 11/2003 Neal et al. ..... 366/10

FOREIGN PATENT DOCUMENTS

EP 0083974 * 7/1983

* cited by examiner

*Primary Examiner*—Thomas A Beach
(74) *Attorney, Agent, or Firm*—Osha Liang LLP

(57) ABSTRACT

An improved method for removing proppant from fluid used in an oil and gas well for reuse in future operations. The proppant is separated from the well fluid and transported to a materials collection tank. A crane then transports the materials collection tank onto a processing boat. On the processing boat, the proppant is vacuumed from the materials collection tank to a hopper. The proppant is then discharged from the hopper into a holding tank for treatment and reuse. In a first alternative embodiment, two hoppers are positioned above each other so that the proppant can be added to the upper hopper and then fed by gravity to the lower hopper. A valving arrangement maintains vacuum within the interior of at least one hopper at all times to provide a continuous vacuum operation. A conduit discharges from the lower hopper into the holding tank.

11 Claims, 5 Drawing Sheets

PROPPANT RECOVERY SYSTEM

CROSS-REFERENCE TO RELATED APPLICATIONS

The present application claims the benefit of 35 U.S.C. 111(b) provisional application Ser. No. 60/336,246 filed Nov. 2, 2001, and entitled Proppant Recovery System.

STATEMENT REGARDING FEDERALLY SPONSORED RESEARCH OR DEVELOPMENT

Not Applicable.

BACKGROUND OF THE INVENTION

1. Field of the Invention

The present invention relates to the disposal of oil and gas well proppant used during the drilling and production of an oil and gas well, wherein a fluid carries excess proppant to a removal area at the well head for separating proppant from the fluid. Even more particularly, the present invention relates to an improved proppant recovery system that collects the excess proppant to later be reused with new proppant.

2. Description of the Related Art

Proppant, e.g., sand, is pumped into wellbore fractures to increase the surface area of the fracture. The increased surface area allows for increased production from the fracture. However, not all of the proppant pumped into the wellbore deposits into the fracture. Instead, some of the proppant remains in the wellbore. This excess proppant must be removed from the wellbore for production from the fracture.

A typical well is designed with up to 10 proppant-fractured zones. The stimulation technique involves the pumping of as much as 300,000 pounds of proppant into each zone. During this process up to 70,000 pounds of excess proppant may remain in the wellbore, which is cleaned out using coiled tubing. The proppant material contains a resin coating to facilitate adhesion in the reservoir, which restricts disposal.

Previously, this excess proppant had to be collected offshore, placed in big bags, contained and shipped to shore for incineration. This practice was costly, wasteful, and environmentally suspect. Engineering studies revealed that the properties of the excess proppant made it suitable to be re-cycled in future operations with minimal impact on fracture performance. While re-using proppant has become an accepted practice with no noticeable effect on well productivity, logistically it had some limitations. The material still had to be collected offshore and transported onshore where it was stored for several months before being reloaded into the stimulation vessel for reuse in the next fracture treatment. This represents storage problems and environmental contamination problems associated with exposure of these materials. Furthermore, even with no unforeseen delays, this was still a time consuming, e.g., 24-hour, two-way trip.

What is desired is a way to recycle the excess proppant in a manner that saves cost. It is also advantageous for the recycle system to be more simple logistically than previous recycle systems. Ideally, but not necessarily, the recovery system would operate entirely on-site without having to transport the excess proppant off-site for processing. Despite the apparent advantages of such a recovery system, to date no such recovery system has been commercially introduced.

SUMMARY OF THE INVENTION

The present invention provides an improved method and system for removing excess proppant from fluid used in an oil and gas well and recovering the excess proppant for reuse in future operations. The preferred embodiment includes separating the excess proppant from the well fluid at the well site. The excess proppant falls via gravity from solid separators (e.g. shale shakers) into a material trough with a chute. At the material trough, cuttings fall through the trough chute into a materials collection tank that has an access opening. A crane then transports the materials collection tank onto a processing boat. On the processing boat, a blower forms a vacuum within the materials collection tank interior via a vacuum line. Along the vacuum line is a hopper for receiving the proppant from the materials collection tank. The excess proppant is then discharged from the hopper into a holding tank for treatment and reuse. Liquids (fluid residue) and solids (proppant) are thus separated from the vacuum line at the hopper before the liquids and solids can enter the blower. In addition, a drop tank is also located along the vacuum line between the hopper and the blower to collect any remaining fluids or solids in the vacuum line before they reach the blower.

In the preferred embodiment, three suction lines are used including a first line that communicates between the materials collection tank and the hopper, a second suction line that extends between the hopper and the drop tank, and a third suction line that communicates between the drop tank and the blower.

In a first alternative embodiment, two hoppers are positioned one above the other so that the proppant can be added to the first, upper hopper via the suction line and then fed by gravity to the second, lower hopper. A valving arrangement maintains vacuum within the interior of the upper hopper at all times to provide a continuous vacuum operation. A conduit discharges from the lower hopper into a holding tank.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED AND ALTERNATIVE EMBODIMENTS

Figure 1:
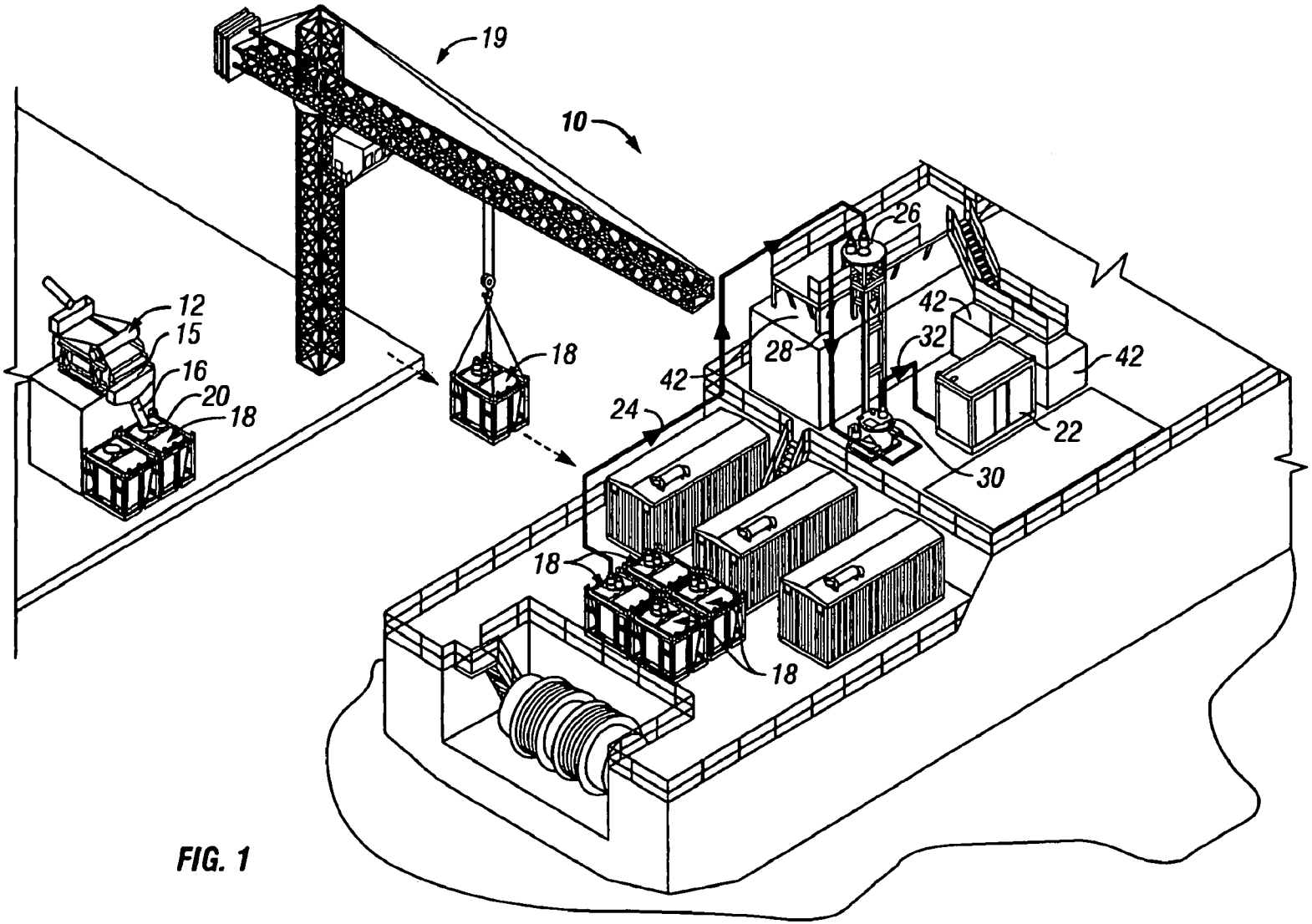
FIG. 1 is a perspective view of the proppant recovery system constructed in accordance with the preferred embodiment.
Figure 2:
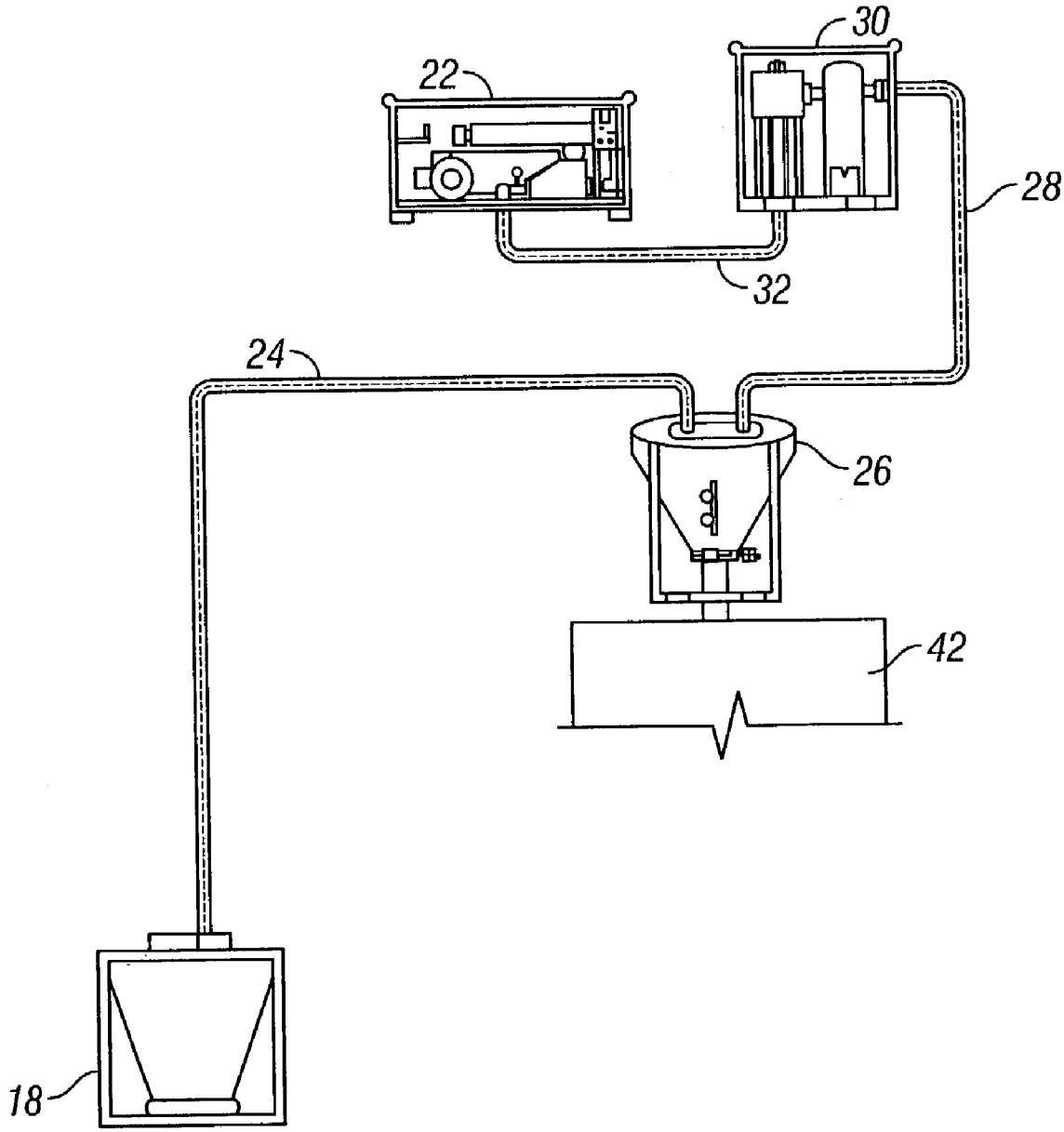
FIG. 2 is a schematic view of the proppant recovery system vacuum line equipment constructed in accordance with the preferred embodiment.
Figure 3:
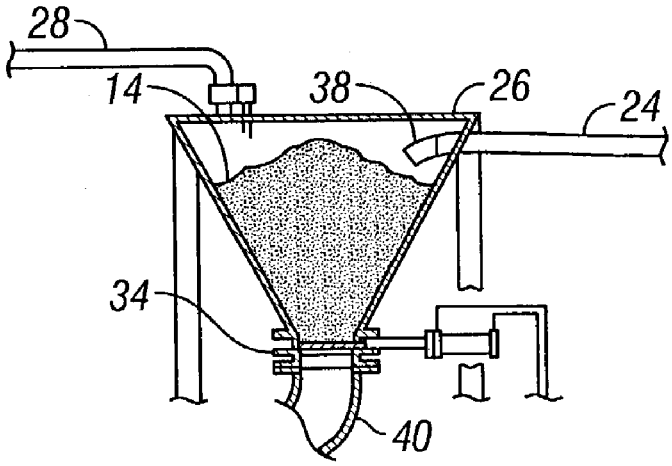
FIG. 3 is a partial elevational view of the proppant recovery system constructed in accordance with the preferred embodiment.
Figure 4:
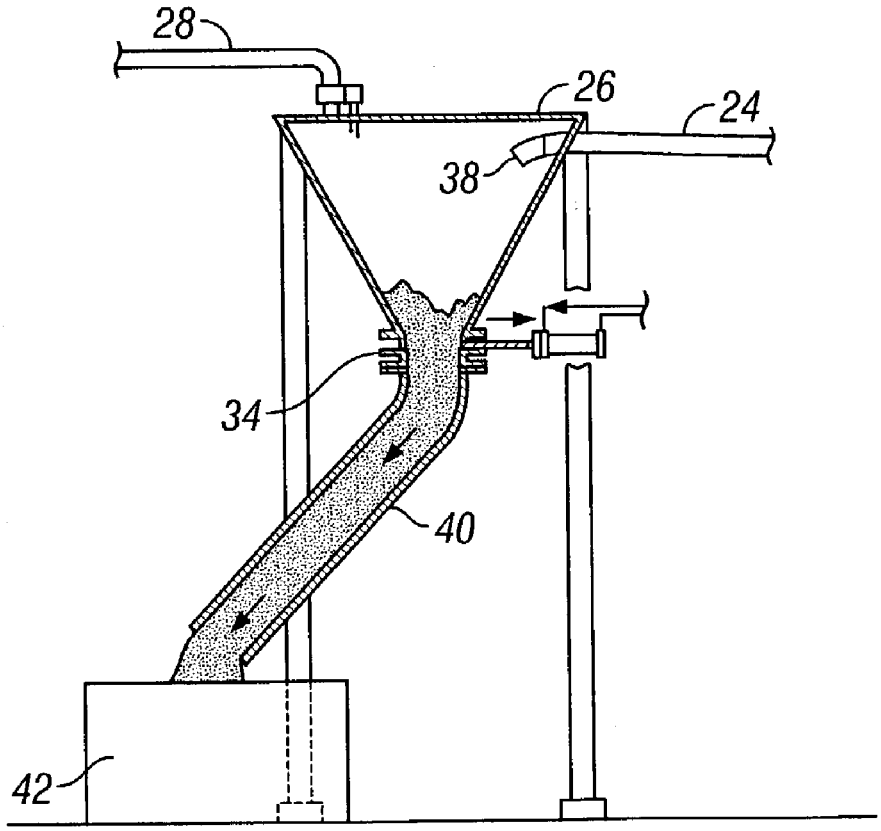
FIG. 4 is a partial elevational view of the proppant recovery system constructed in accordance with the preferred embodiment.

"Referring initially to FIGS. 1–4, there is shown a recovery system 10 constructed in accordance with the preferred embodiment. The recovery system 10 removes excess proppant 14 from fluid used in an oil and gas well and recovers the excess proppant 14 for reuse in future operations. It should be appreciated that the system 10 can be used with any type of proppant material. The recovery system 10 separates the excess proppant 14 from the well fluid on a drilling platform "A". The excess proppant 14 and any residual fluid falls via gravity from solid separators 12 (e.g. shale shakers) into a material trough 15 with a chute 16. At the material trough 15, the proppant 14 falls through the trough chute 16 into a materials collection tank 18 that has an access opening 20. Alternatively, the recovery system 10 includes a compressed air blower (not shown) to assist the proppant 14 and any residual fluid through the chute 16 when the proppant 14 and residual fluid need to be broken up. U.S. Pat. No. 6,179,070 provides an example of a materials collection tank that can be used with the present invention and is hereby incorporated herein by reference for all purposes. A crane 19 then transports the materials collection tank 18 onto a processing boat "B". It should be appreciated by those skilled in the art that any suitable transportation means may be used to transport the materials collection tank 18. On the processing boat "B", a blower 22 is in fluid communication with the materials collection tank 18 via a vacuum line 24 from the materials collection tank to a hopper 26, a vacuum line 28 from the hopper 26 to a drop tank 30, and a vacuum line 32 from the drop tank 30 to the blower 22. The blower 22 thus forms a vacuum within the materials collection tank 18 interior to transport the proppant 14 through the vacuum line 24 for discharge into the hopper 26."

Valve 34 operates to open and close the discharge 40 of the hopper 26. Initially, the valve 34 is closed while the hopper 26 is filled with the proppant 14. When the hopper 26 is full, the valve 34 is opened to discharge the proppant 14 from the hopper 26 into a holding tank 42 for processing and reuse. The proppant 14 is thus separated from the vacuum line 24 at the hopper 26 before the proppant 14 can enter the blower 28. In addition, the drop tank 30 is also located along the vacuum line 28 between the hopper 26 and the blower 22 to collect any remaining proppant 14 in the vacuum line 28 before they reach the blower 22.

Thus, the recovery system 10 recycles the proppant 14 in a manner that saves cost by providing an efficient recycling system. The recovery system 10 is also capable of operating entirely on-site without having to transport the excess proppant 14 off-site for processing.

Patents describing transportation systems for wellbore solids include U.S. Pat. Nos. 5,402,857; 5,564,509; 5,839,521; 5,842,529; 5,913,372; 5,971,084; 6,009,959; 6,179,070B1; 6,179,071B1; and 6,213,227B1, all incorporated herein by reference for all purposes.

Referring now to FIGS. 5–8, there is shown a proppant recovery system 110 constructed in accordance with an alternative embodiment. The alternative embodiment proppant recovery system 110 of FIGS. 5–8 is similar in overall layout to the preferred embodiment recovery system 10. The difference is that instead of a single hopper 26, the suction line 24 from the materials collection tank (not shown) communicates with an upper hopper 126. Instead of being a single hopper, however, the hopper 126 is an upper hopper positioned above a lower hopper 127. The upper hopper 126 is still subjected to the vacuum applied by the blower (not shown) through the vacuum line 128 from the upper hopper 126 to the drop tank (not shown) and the vacuum line (not shown) from the drop tank to the blower. Thus, the proppant recovery system 110 represents a double hopper 126, 127 arrangement that replaces the single hopper 26 of recovery system 10.

Figure 5:
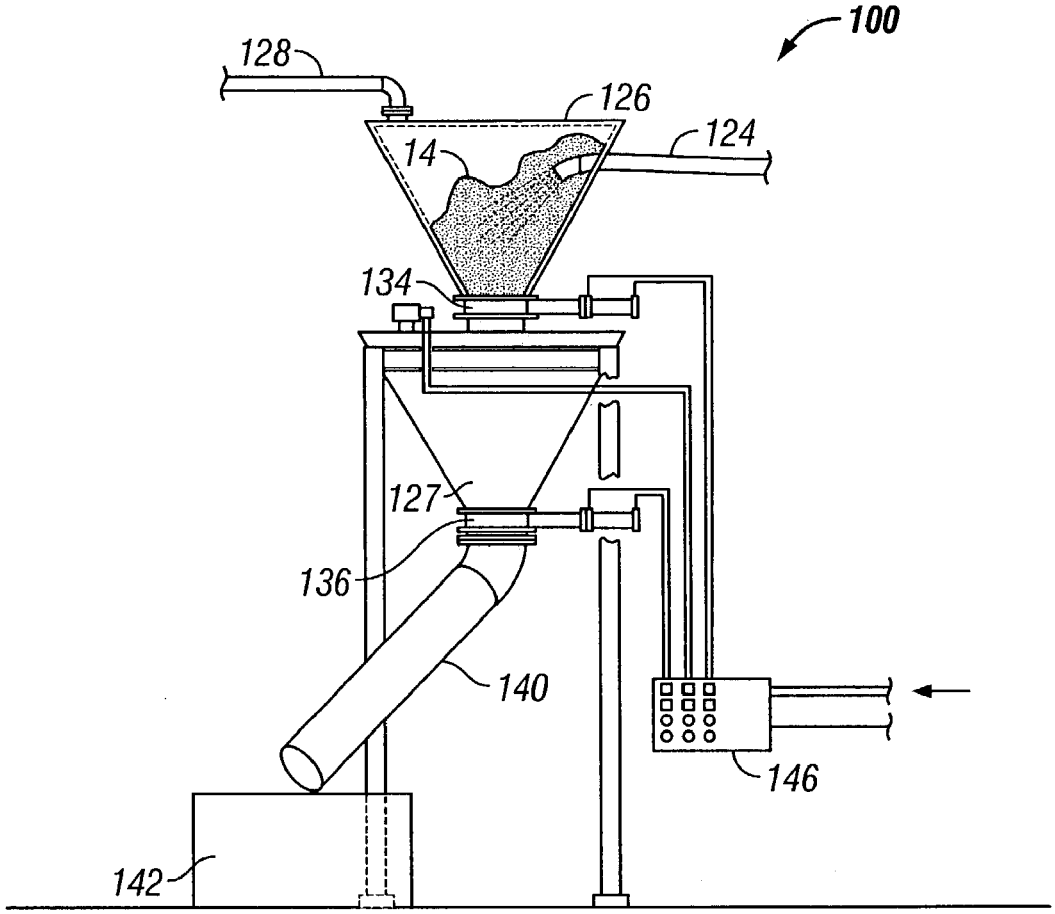
FIG. 5 is a partial elevational view of the proppant recovery system constructed in accordance with an alternative embodiment.
Figure 6:
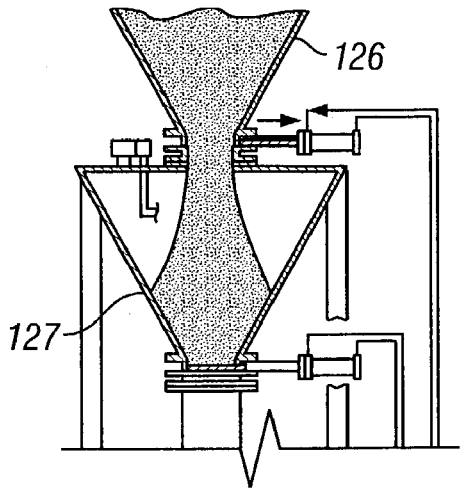
FIG. 6 is a partial elevational view of the proppant recovery system constructed in accordance with an alternative embodiment.
Figure 7:
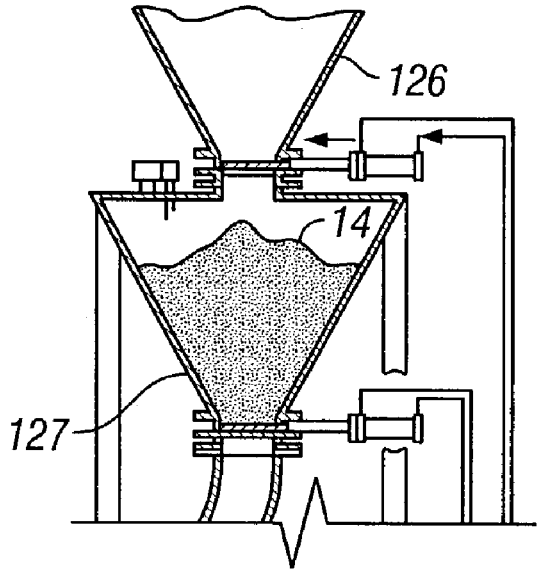
FIG. 7 is a partial elevational view of the proppant recovery system constructed in accordance with an alternative embodiment.
Figure 8:
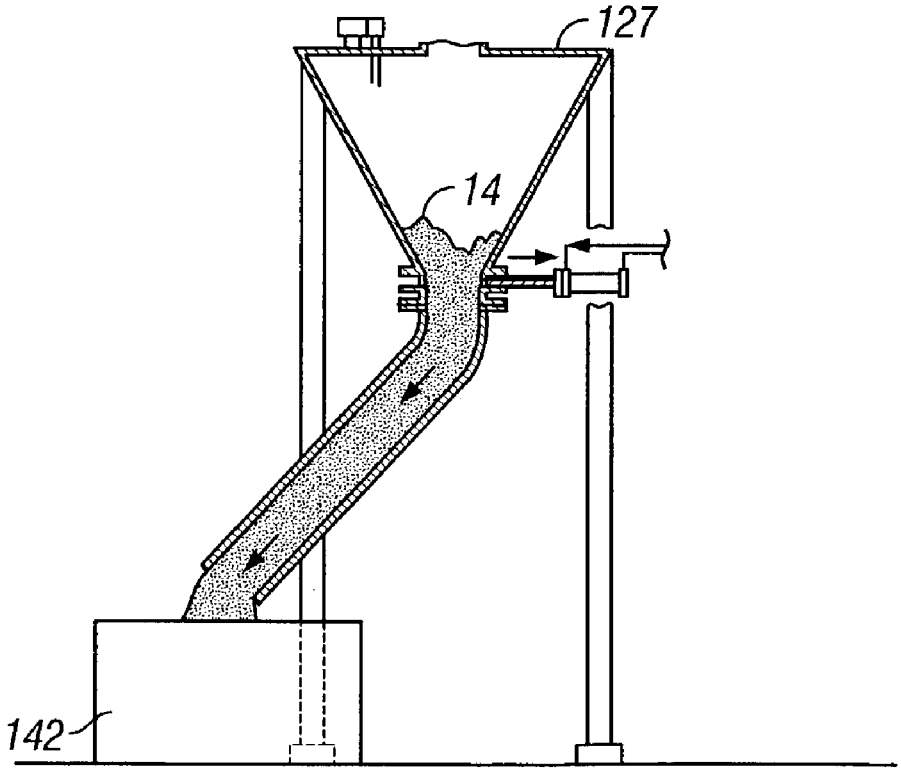
FIG. 8 is a partial elevational view of the proppant recovery system constructed in accordance with an alternative embodiment.

As shown in FIGS. 5 and 6, valves 134, 136 control the flow of the proppant 14 between the upper hopper 126 and the lower hopper 127. The valves 134, 136 also control the flow of the proppant from the lower hopper 127 to discharge 140 and then to holding tank 142. A user controls the valves 134, 136 using a control panel 146 and pneumatic or hydraulic controllers (commercially available) to direct flow from the upper hopper 126 to the lower hopper 127, and then to the holding tank 142. Valves 134, 136 can be pneumatic actuated flex-gate knife valves, for example, manufactured by Red Valve Company, Inc. of Pittsburgh, Pa., USA.

The upper valve 134 is initially closed (FIG. 5) so that suction lines 124, 128 begin filling the hopper 126. As the hopper 126 becomes almost filled, the valve 134 opens while the lower valve 136 remains closed (FIG. 6). In FIG. 6, both of the hoppers 126, 127 are subjected to a vacuum. However, the vacuum does not prevent the proppant 14 collected in the upper hopper 126 from falling through the valve 134 and into the lower hopper 127. This transfer of the proppant 14 from the upper hopper 126 to the lower hopper 127 is shown in FIG. 6. As the proppant 14 is discharged from the upper hopper 126 to the lower hopper 127, the valve 136 remains closed as shown in FIG. 6. This closure of the valve 136 ensures that the vacuum is maintained on the interiors of both of the hoppers 126, 127. Otherwise, if the valve 136 were opened, the vacuum would be lost.

Once the proppant 14 has been transported from the upper hopper 126 to the lower hopper 127, the valve 134 is closed so that the valve 136 can be opened. When this occurs, the upper valve 134 is in its closed position to preserve the vacuum within the upper hopper 126. Once that vacuum is preserved within the upper hopper 126, the valve 136 can then be opened (FIG. 8) so that the proppant 14 within the lower hopper 127 can be discharged into the discharge 140 and then into the holding tank 142. The proppant 14 can then be held in the holding tank 142 for treatment and reuse. The valving arrangement maintains vacuum within the upper hopper 126 at all times to provide a continuous vacuum operation.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A method of recovering proppant from fluid used in an off-shore oil and gas well bore comprising:

separating the proppant from at least substantially all of the well bore fluid;

transporting the separated proppant to a materials collection tank;

transporting the materials collection tank to a proppant recovery area;

forming a vacuum within a hopper with a blower, the blower being in fluid communication with the hopper;

suctioning the separated proppant with a suction line; transporting the separated proppant via the suction line to the hopper;

discharging the separated proppant from the hopper into a holding tank;

processing the separated proppant offshore without an intervening transport of the separated proppant to an on-shore location; and re-using the processed proppant in an off-shore well operation.

2. The method of claim 1 further comprising transporting the separated proppant to a second hopper and filling and emptying the hoppers in an alternating sequence.

3. The method of claim 2 further comprising separating the hoppers from one another with a valving member.

4. The method of claim 1 further comprising removing the separated proppant from the suction line at the hopper.

5. The method of claim 2 further comprising removing the separated proppant from the suction line at the hopper.

6. The method of claim 2 wherein the two hoppers are positioned vertically one on top of the other such that the separated proppant can flow via gravity from one hopper to the other hopper.

7. The method of claim 6 further comprising operatively associating at least one valve with the hoppers to maintain a vacuum within the hopper when the separated proppant flows via gravity from the hopper to the second hopper or from the second hopper to the holding tank such that the separated proppant may be continuously transported from the materials collection tank.

8. The method of claim 1 further comprising using a crane to transport the materials collection tank to the proppant recovery area.

9. The method of claim 2 further comprising using a crane to transport the materials collection tank to the proppant recovery area.

10. The method of claim 1 wherein the proppant recovery area comprises an off-shore vessel.

11. The method of claim 2 wherein the proppant recovery area comprises an off-shore vessel.

* * * * *